US009004197B2

(12) United States Patent
Roussie et al.

(10) Patent No.: US 9,004,197 B2
(45) Date of Patent: Apr. 14, 2015

(54) DRILL STEM COMPONENTS AND STRING OF COMPONENTS

(75) Inventors: Gabriel Roussie, Valenciennes (FR); Christophe Rohart, Aulnoye-Aymeries (FR)

(73) Assignee: Vam Drilling France, Cosne Cours sur Loire (FR)

( * ) Notice: Subject to any disclaimer, the term of this patent is extended or adjusted under 35 U.S.C. 154(b) by 347 days.

(21) Appl. No.: 13/511,240

(22) PCT Filed: Nov. 15, 2010

(86) PCT No.: PCT/FR2010/000761

§ 371 (c)(1),
(2), (4) Date: May 22, 2012

(87) PCT Pub. No.: WO2011/064467

PCT Pub. Date: Jun. 3, 2011

(65) Prior Publication Data

US 2012/0228034 A1 Sep. 13, 2012

(30) Foreign Application Priority Data

Nov. 27, 2009 (FR) ..... 09 05712

(51) Int. Cl.
*E21B 17/00* (2006.01)
*E21B 17/10* (2006.01)
*E21B 17/22* (2006.01)

(52) U.S. Cl.
CPC ..... *E21B 17/1085* (2013.01); *E21B 17/22* (2013.01)

(58) Field of Classification Search
USPC ..... 166/241.1, 241.2, 241.4, 241.6, 241.7; 175/320, 325.1, 325.2, 325.5, 325.6, 175/325.7; 285/45, 373, 419
See application file for complete search history.

(56) References Cited

U.S. PATENT DOCUMENTS

| | | | |
|---|---|---|---|
| 3,942,824 | A | 3/1976 | Sable |
| 4,484,785 | A | 11/1984 | Jackson |
| 4,615,543 | A | 10/1986 | Cannon |

(Continued)

FOREIGN PATENT DOCUMENTS

| | | |
|---|---|---|
| FR | 2 789 438 | 8/2000 |
| FR | 2 835 014 | 7/2003 |

(Continued)

OTHER PUBLICATIONS

International Search Report issued on Jan. 31, 2011 in PCT/FR10/000761 filed on Nov. 15, 2010.

*Primary Examiner* — Kenneth L Thompson
*Assistant Examiner* — Taras P Bemko
(74) *Attorney, Agent, or Firm* — Oblon, McClelland, Maier & Neustadt, L.L.P.

(57) ABSTRACT

The invention relates to a rotary drill stem component for exploration of a hydrocarbon well with drilling mud in movement around the component from a bottom of the well towards the surface. The drill can include a central tubular element having an axis of revolution and extended on either side respectively by a first and a second tool joint each respectively and successively including a first cylindrical portion connected to the tubular element, a second tapered portion, a third cylindrical portion with a radius greater than that of the tubular element. The drill can include a threaded end which can connect the component to another component, the component including a first shell provided with one or more functional zones, the first shell being mounted on one of the tool joints in a cohesive and removable manner.

13 Claims, 9 Drawing Sheets

(56) References Cited

U.S. PATENT DOCUMENTS

| | | | | |
|---|---|---|---|---|
| 4,844,179 | A * | 7/1989 | Forrest et al. | 175/92 |
| 5,803,193 | A * | 9/1998 | Krueger et al. | 175/325.1 |
| 2004/0195009 | A1 | 10/2004 | Boulet | |

FOREIGN PATENT DOCUMENTS

| | | |
|---|---|---|
| FR | 2 851 608 | 8/2004 |
| FR | 2 927 937 | 8/2009 |
| WO | 2005/093204 | 10/2005 |

* cited by examiner

DRILL STEM COMPONENTS AND STRING OF COMPONENTS

BACKGROUND

1. Field of Disclosure

The invention relates to drill stem components used for the rotary drilling of oil or gas fields. In particular, the invention is applicable to components used in a drill stem such as drill pipes or heavy weight drill pipes, for example.

2. Description of Related Art

Rotary drill pipes connected together to form drill strings and associated with other components of the drill stem (drill collars, stabilizers, etc) can be used to produce deviated bores, i.e. bores wherein the inclination to the vertical or the horizontal direction can be varied during drilling. Deviated bores can currently reach depths of the order of 2 to 8 km and horizontal distances of the order of 2 to 15 km.

However, in the case of deviated holes, a number of problems arise which are directly linked to the variation in the inclination of the bore.

Firstly, on sections of drill strings that are almost horizontal, frictional torques may reach very high values during drilling under the effect of the weight of the components employed on those sections. This results in premature wear of the components employed on those sections.

Next, because the hole is no longer rectilinear, it is much more difficult for mud loaded with debris derived from excavating the rock to ascend when it is not straight. This results in poor cleaning of the hole and an increase both in the coefficients of friction of the pipes of the drill string inside the drilled hole and the contact surfaces between the pipes and the walls of the hole.

Finally, because the trajectory followed by the drill string is no longer rectilinear, it appears that the distribution of vibrations along such strings is no longer homogeneous. For this reason, bending stress concentrations that are over the admissible limits risk damaging the drill strings in certain regions.

In order to overcome these disadvantages, the prior art has proposed a variety of arrangements.

Thus, document FR 2 851 608 describes a drill pipe provided with a bearing zone having a hard coating so that at that region, the contact surface with the walls of the hole is wear-resistant. Furthermore, activation zones which are helical in shape can accelerate the ascent of drilling fluid and debris derived from drilling.

Similarly, document FR 2 835 014 proposes drill pipe profiles with depressions and projections which are arranged to facilitate the ascent of drilling debris.

Clearly, those solutions have produced very satisfactory results. However, the current solutions require that the drilling components be machined in order to obtain the activation zones, and the bearing zones of said components have to be treated in order to obtain a wear-resistant coating. More generally, adding such functions to the drilling components has a huge impact on the manufacture of such components.

Document WO-2005/93204 proposes a device that can be fixed on a drilling component in a removable manner and has functional zones which can facilitate the movement of drilling mud and the ascent of debris as well as progress of the component during drilling. The device is constituted by two half-shells connected together via a pivotal connection; the device docks with the drilling component by means of a clamping system which positions the half-shells flush against each other.

However, this solution suffers from the disadvantage of rendering the drilling component fragile. The fact that the device surrounds the component generates a zone with a high concentration of stresses. The effect of this is that the drilling component can break in service, or it can become detached from the device carrying the functional zones.

The invention proposes a drilling component comprising functional zones that are even more resistant in operation.

More precisely, a rotary drill stem component for exploration of a hydrocarbon well with drilling mud in movement around said component from the bottom of the well towards the surface comprises a central tubular element having an axis of revolution and extended on either side respectively by a first and a second tool joints each respectively and successively comprising a first, cylindrical, portion connected to the tubular element, a second, tapered, portion, a third, cylindrical, portion with a radius R which is greater than that of the tubular element, and a threaded end which can connect the component to another component. The component comprises a shell with one or more functional zones provided on its circumferential surface. The shell is mounted on one of the tool joints in a cohesive and removable manner.

SUMMARY

Optional complementary or substitutional characteristics of the invention are defined below.

The shell may be screwed against the tapered portion of one of the tool joints using screws accommodated in housings which may be threaded, for example, formed in the shell and in the tapered portion and coaxial therewith.

The shell may be fixed against the second tapered portion of one of the tool joints using at least one pin passing through said shell, said pin being fixed at one of its ends in a recess formed in the tool joint and by means of a nut screwed onto the other end of the pin.

The internal circumferential surface of the shell constituted by two half-shells, and also the external circumferential surface of the third cylindrical portion of one of the tool joints may be complementary such that the first shell can be fitted onto the third cylindrical portion.

The component may comprise a first and a second shell, one of the two faces of the first shell being capable of being fitted into one of the two faces of the second shell, such that the shells are secured together by means of a bayonet type fitting.

The functional zones may comprise a first fluid activation zone downstream of which a first bearing zone is provided, downstream of which a second fluid activation zone is provided, downstream of which a second bearing zone is provided, and downstream of which a third fluid activation zone is provided, the terms "upstream" and "downstream" being defined with respect to the direction of movement of mud along said component.

Said activation zones may comprise a plurality of grooves hollowed into the surface of the shell(s) and extending in a helical manner about the axis of the central tubular component.

The surface on which the first activation zone is provided may be inclined in the upstream to downstream direction such that it draws further away from the axis of the central tubular element, in order to guide mud along the component.

The surface on which the second activation zone is provided may be concave in order to guide mud along the component.

The surface on which the third activation zone is provided may be inclined in the upstream to downstream direction such that it draws nearer to the axis of the central tubular element in order to guide mud along the component.

The surface on which the first and second bearing zones are provided may be convex in order to limit friction between the shell and the wall of the well.

The activation zones and the bearing zones may be connected together in a tangential manner.

The shell(s) may be mounted in a cohesive and removable manner on a tool joint provided with a threaded male end.

The invention also concerns a string of components of a rotary drill stem wherein a component in accordance with one embodiment of the invention is involved in the constitution of the drill pipe string with a periodicity equal to three.

BRIEF DESCRIPTION OF THE DRAWINGS

The present invention will be better understood from the following detailed description of several embodiments given by way of entirely non-limiting examples and illustrated in the accompanying drawings, in which.

DETAILED DESCRIPTION

Figure 1:
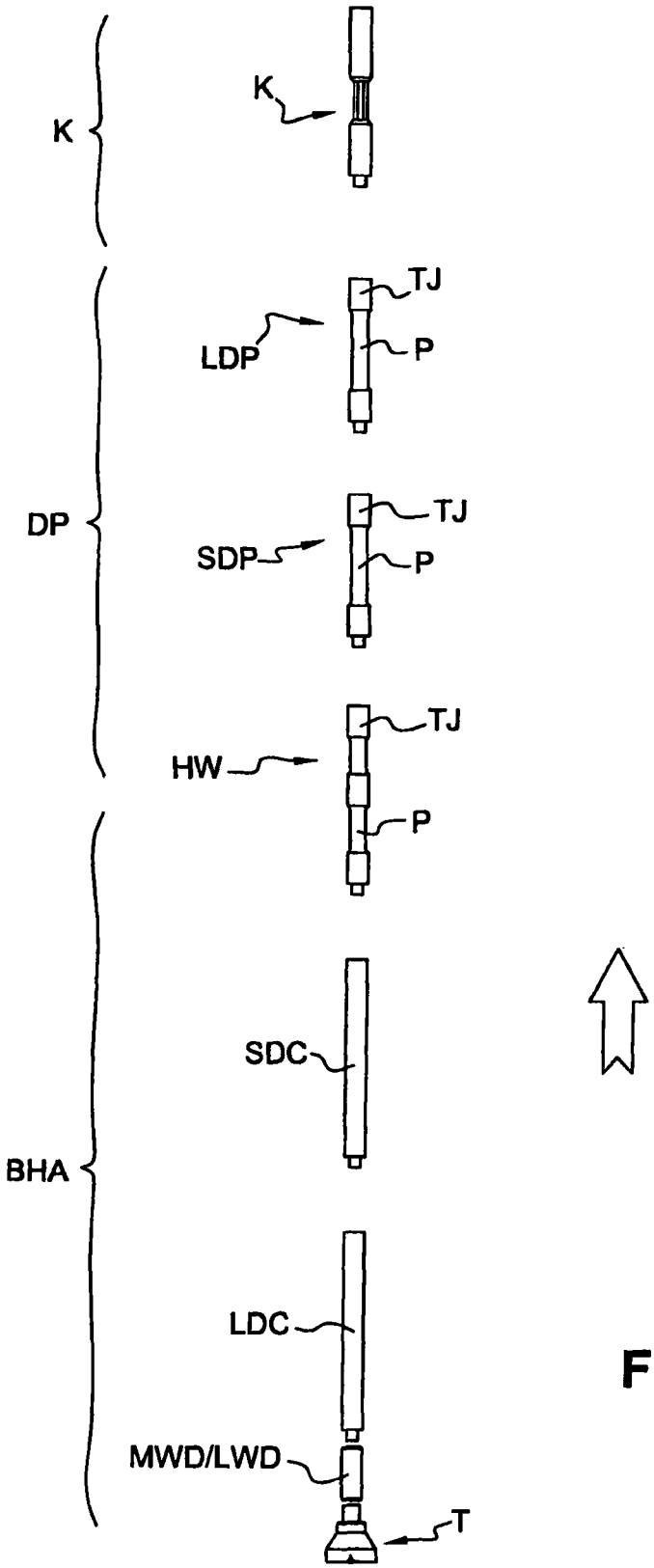
FIG. 1 is a diagrammatic view of a drill stem.

FIG. 1 shows a diagrammatic view of a conventional drill stem. The term "drill stem" is given to the set of components in the assembled position, which is intended to be lowered into the well in order to excavate the latter. Conventionally, a drill stem comprises a first portion intended to excavate the bottom of the well and termed the BHA (bottom hole assembly). At its end connected to the drill bit T, it comprises thick tubular components machined from a single piece and with a constant section over their entire length, termed MWD/LWD (measurement while drilling/login while drilling) and collars. These LDC, SDC (larger drill collars, smaller drill collars) have diameters which increase in the direction of the collar. At the other end from that carrying the drill bit, the BHA may also comprise HW (heavy weight) tubes. Between the BHA and the surface of the well, a succession of tubular components SDP and LDP (smaller drill pipes and larger drill pipes) is normally present. These tubular components are generally constituted by a central tube at the ends of which tool joints are welded, namely tubular components with a larger diameter comprising a threading for connection.

In order to resist mechanical stresses, the tubular components may have a section that increases in thickness as the drill bit is approached. Thus, on approaching the surface of the well, the drill pipes may have a central tube diameter which is smaller in order to economize on material, while the welded tool joints must retain a certain thickness in order to keep the connection portions reliable.

During rotary drilling, a drilling fluid is guided under pressure into the drill stem to the bottom of the well. Partly due to the pressure, it rises to the surface, entraining therewith debris from rocks excavated by the drill bit.

Figure 2:
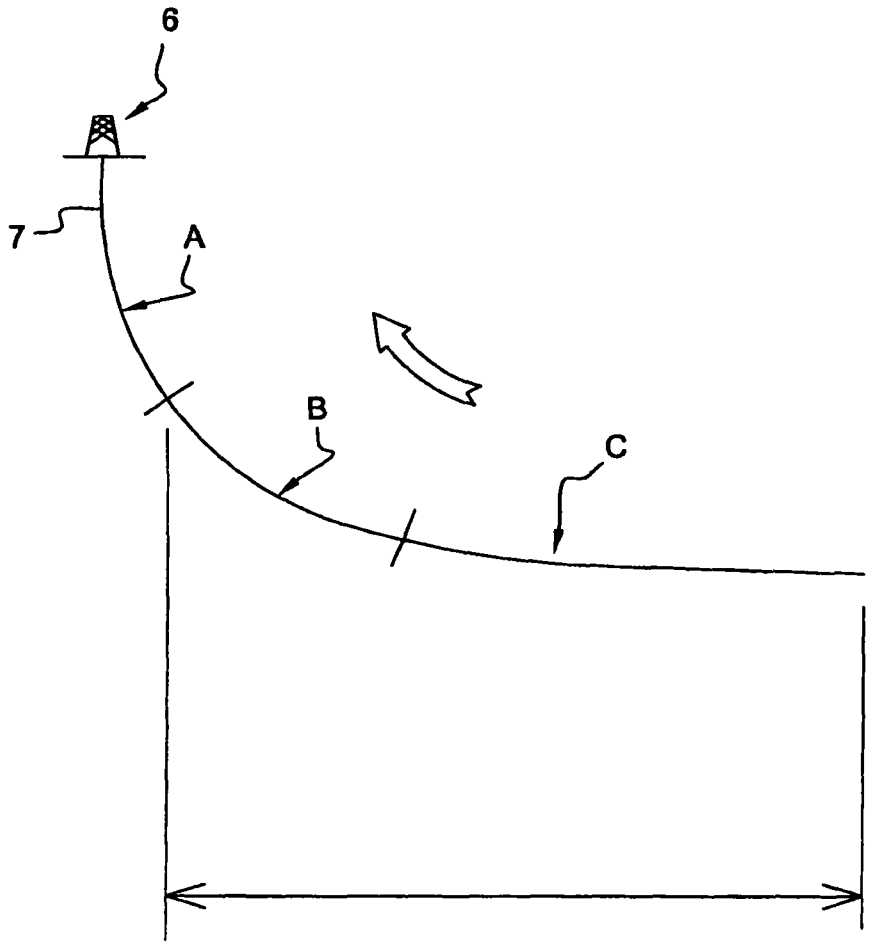
FIG. 2 is a diagrammatic view of a well.

FIG. 2 shows a diagrammatic view of a drilled well comprising a first zone opening at the surface 6 where the drill stem is introduced, and a second, subterranean zone 7. The subterranean zone 7 is divided into three portions, namely a vertical portion A, an inclined portion B and a horizontal portion C.

Figure 3:
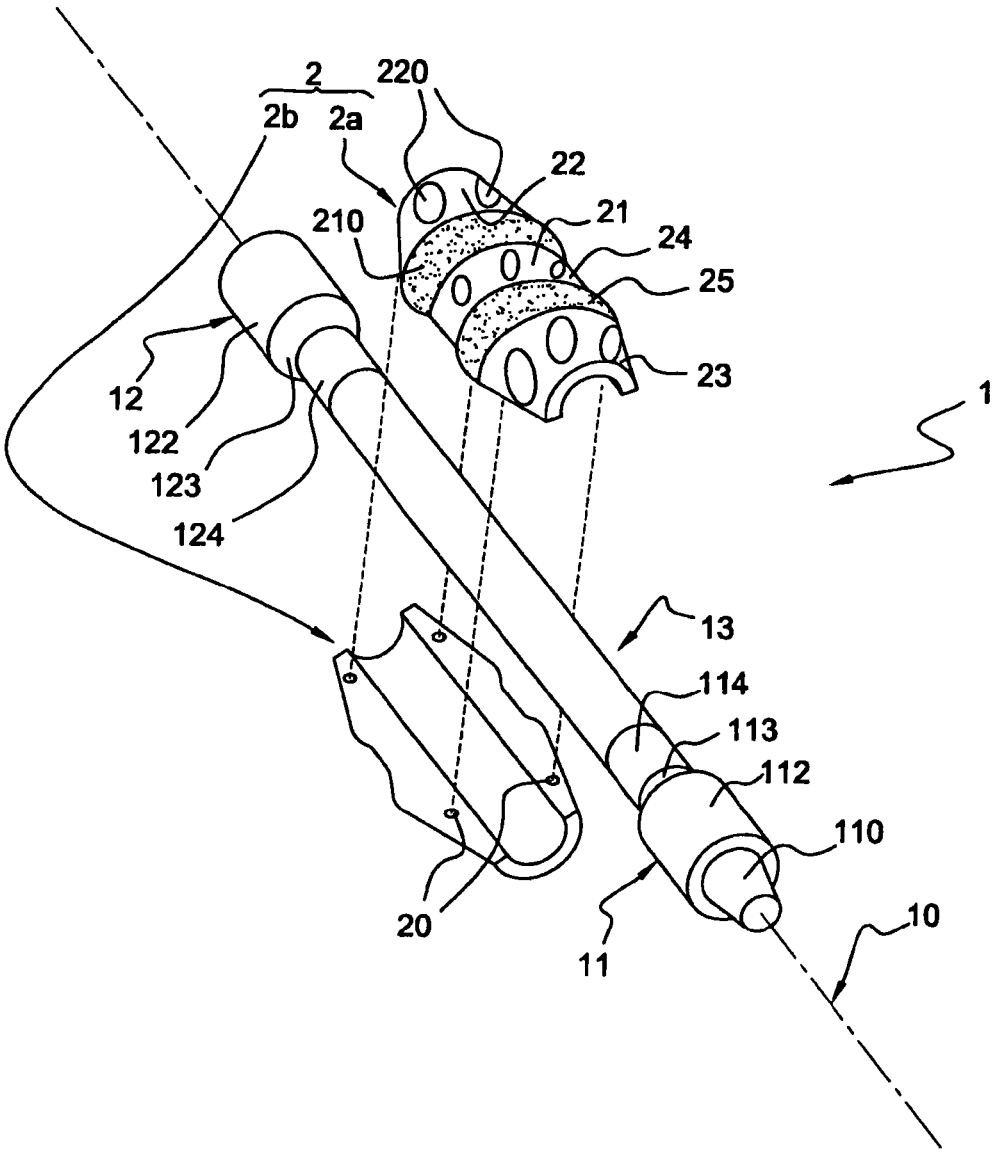
FIGS. 3 to 10 are perspective views of various embodiments of the invention.
Figure 4:
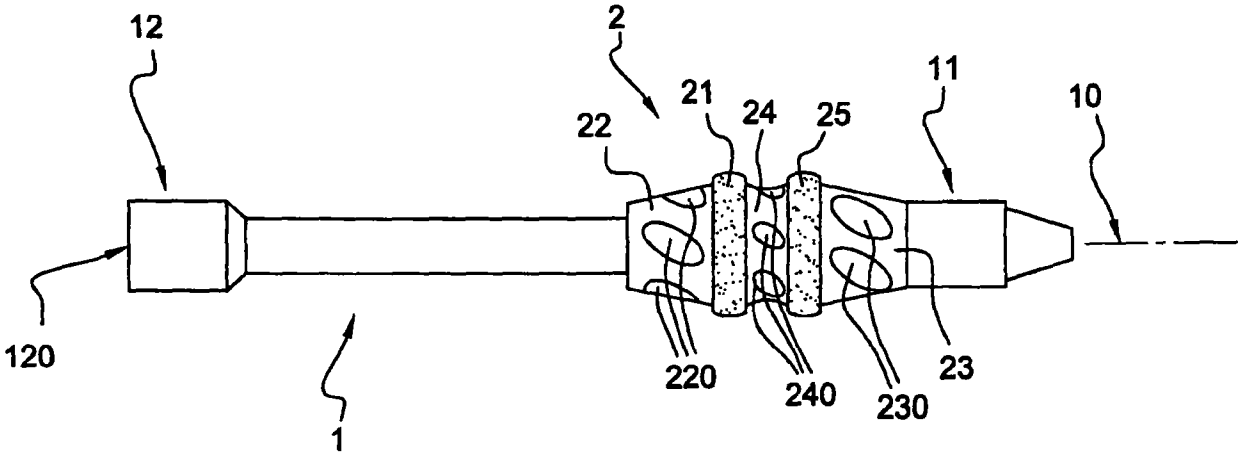

FIGS. 3 and 4 each represent an example of a drilling component 1 comprising a tubular element 13 provided with a female tool joint 12 and a male tool joint 11. The tool joints 11 and 12 are tubular components which are generally attached to the tubular element 13 by friction welding. These tool joints 11 and 12 each respectively and successively comprise a first cylindrical portion 114, 124 connected to a tubular element 13 and with a radius r substantially equal to that of the tubular element 13, a second tapered portion 113, 123, a third cylindrical portion 112, 122 with radius R which is substantially greater than that of the tubular element 13, and a threaded element 110, 120 which can connect the component to another component. The meaning of the statement that the first cylindrical portion 114, 124 has a radius r substantially equal to that of the tubular element 13 means that there is conservation of diameter at the junction between the first cylindrical portion and the tubular element. This is confirmed by the fact that the junction is normally produced by welding.

The tubular element 13 has an axis of revolution 10. The drilling component 1 also comprises a shell 2 which can be securely attached to one of the tool joints. The term "capable of being securely attached" means that the shell 2, once fixed, can neither translate nor turn with respect to the tool joint. Functional zones are applied to a shell 2, which shell is itself fixed on a component of the drill stem, either before said component is connected to others, or afterwards. The term "functional zones" means surfaces applied to the drilling components which may be used to accelerate the movement of mud around said components. These surfaces generally have particular shapes facilitating fluid flow. The term "functional zones" also means the surfaces attached to the drilling components, which are designed to accommodate shocks and friction arising during drilling. The term "functional zones" also means portions applied to the shell which house electronic components. These electronic components may be intended to measure, process and/or transmit signals.

Applying functional zones to a drill stem of the invention is simpler and more flexible. It is not necessary to machine and produce surface coatings directly on the tubular elements constituting the drill stem in order to obtain these activation zones. In other words, this means that additional equipment can be avoided as well as complex manufacturing steps. Further, the shells can be manufactured separately and the shell can be connected to the tubular elements away from the shop producing the tubular elements, or even at the drilling site (rig). Further, this means that only the shell needs to be changed, or only the tubular element if only one of the two is damaged. The fact that the shell is fixed on the tool joint and not on the tubular element 13 avoids the generation of stress concentrations at the tubular element which is much thinner than the tool joints. In other words, fixing the shell on the tool joints, which are much thicker than the tubular elements, is highly advantageous as it does not render the drilling components fragile.

Fixing the shell on a single tool joint 11, 12 of the two tool joints lets a great freedom in mounting. Fixing the shell on a single tool joint 11, 12 of the two tool joints exempts a strict order of assembly between the assembly of the shell 2 of a tool joint 11, 12 and screwing components 1 of a drill with each others. It can be mounted, in a first step, a shell 2 on a single of the two tool joints 11, 12, in a second step, screwing the two tool joints 11, 12 of two components 1 of a drill. It can be mounted, in a first step, a shell 2 on each of the two tool joints 11, 12, in a second step, screwing two tool joints 11, 12 of two components 1 of a drill. It can be screwed, in a first step, two tool joints 11, 12 of two components 1 of a drill, in a second step, fixing a shell 2 on a single of the two tool joints 11, 12. It can be screwed, in a first step, two tool joints 11, 12 of two components 1 of a drill, in a second step, fixing a shell 2 on each of the two tool joints 11, 12.

The shell 2 can be set in the tool joint in a variety of manners. According to one manner, the preliminary screwing of components 1 of a drill is independent of the fixing of (the) shell(s) 2 on the tool joint(s) 11, 12. According to one manner, the shell 2 can extend from the tool joint 11, 12 onto a portion of the tubular element 13. According to one manner, it can be provided with support elements between the outer circumferential surface of the tubular element 13 and the inner circumferential surface of the shell 2. Said support elements increase stability in translation and/or in rotation between the shell 2 and the stem of drill components. The support elements could comprise pins protruding in hollows.

Figure 5:
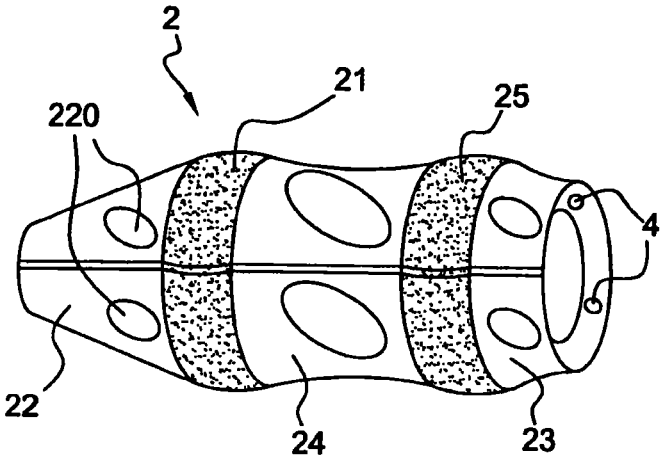
Figure 6:
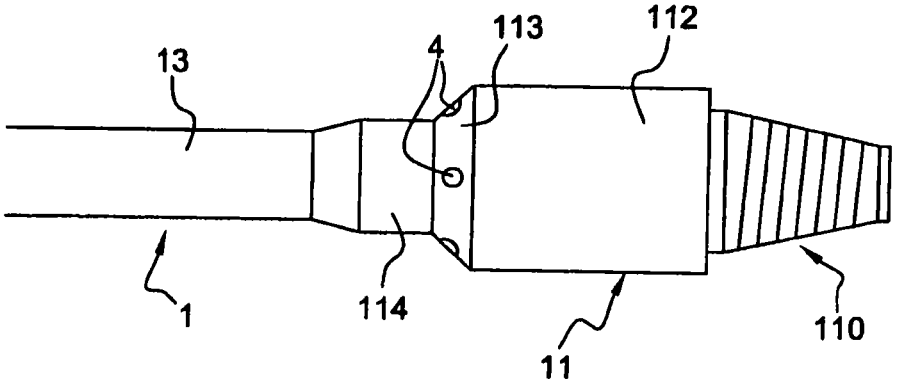

In one embodiment shown in FIGS. 5 and 6, the shell 2 may consist of a single element with a generally tubular shape and with an internal diameter that is adjusted with respect to the external diameter of the tubular element 13 so that it can be mounted on said tubular element.

In one embodiment shown in FIG. 4, the shell 2 is composed of two half-shells 2*a* and 2*b* which can be connected in order to clamp around the tool joint 11 and form the shell 2.

In one embodiment shown in FIGS. 5 and 6, the shell 2 is fixed against the tapered portion 113 of the tool joint 11 by screwing using mutually coaxial threaded housings 4 produced in the shell and in the tapered portion. This mode of mounting has the advantage of being simple to carry out, as it is only necessary to provide threaded housings and the corresponding screws.

Figure 7:
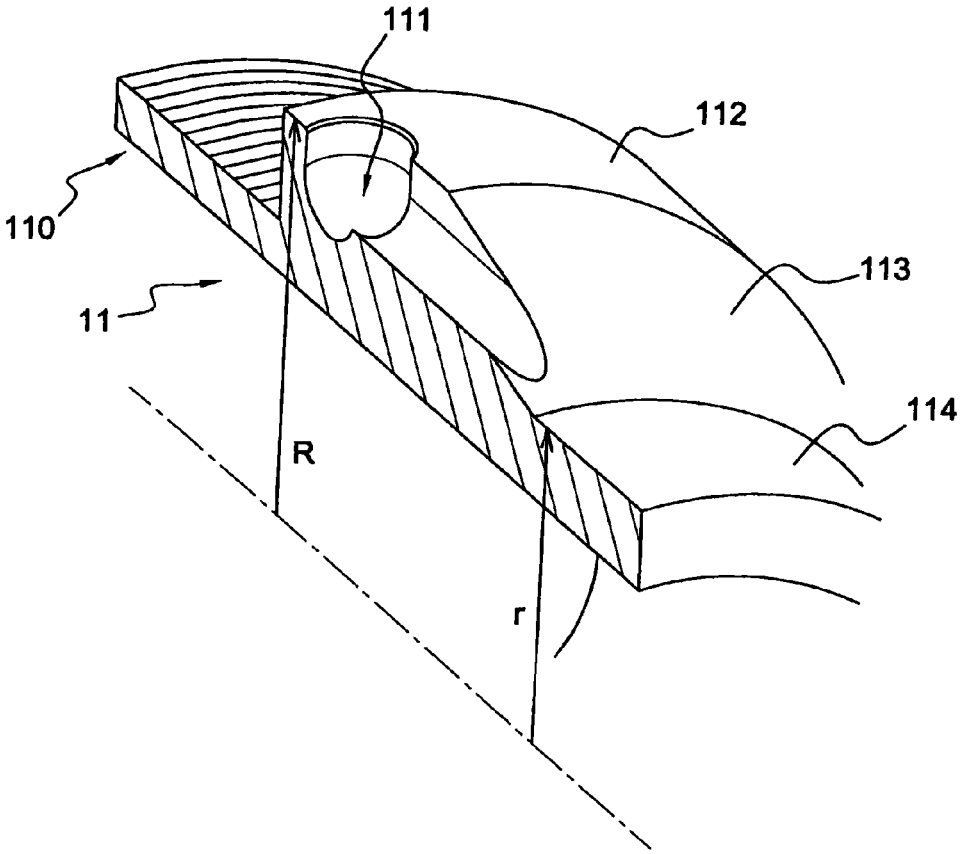
Figure 8:
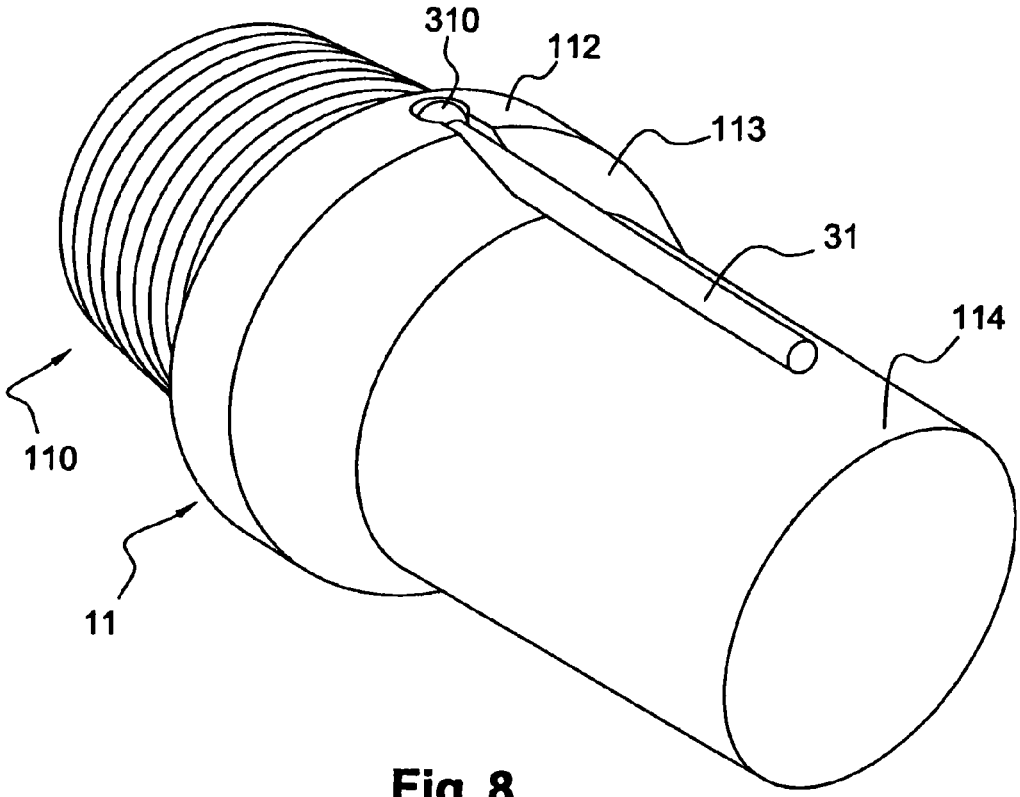

In accordance with one embodiment shown in FIGS. 7 and 8, the shell 2 is fixed against the tapered portion 113 of the tool joint 11 using a pin 31 passing through said shell, one end 310 of said pin being fixed in a recess 111 formed in the tool joint and by means of a nut 32 screwed to the other end of the pin.

Figure 9:
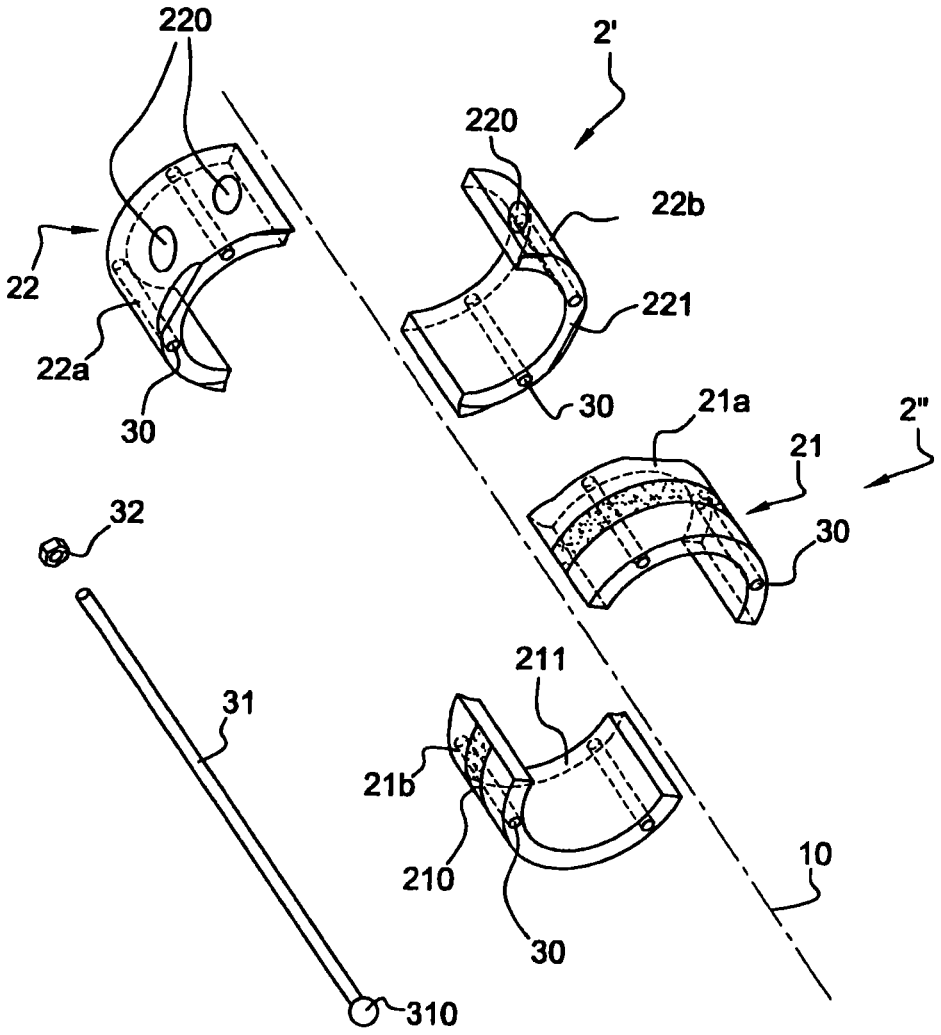

FIG. 9 shows a variation comprising two shells 2' and 2", each constituted by two semi-annular half-shells. The set of half-shells (four in total) is fixed using four pins passing through openings 30 formed in the half-shells aligned with the axis 10 of the tubular element, the junction of the half-shells constituting the shell 2 being located in a plane substantially perpendicular to the plane in which the junction of the half-shells constituting the shell 2' is located.

Advantageously, one, 221, of the two faces of the first shell 2' can be fitted against one, 211, of the two faces of the second shell 2", such that the shells are secured together by means of a bayonet type mount.

The advantage of using two or even more shells is particularly interesting when each of the shells carries a single functional zone. This allows for great flexibility insofar as each drilling component can be provided with particular functions which depend on the manner in which it is used. As an example, it would be possible to specify that bearing zones are to be used for the drilling components employed in the horizontal portion C of the well.

Figure 10:
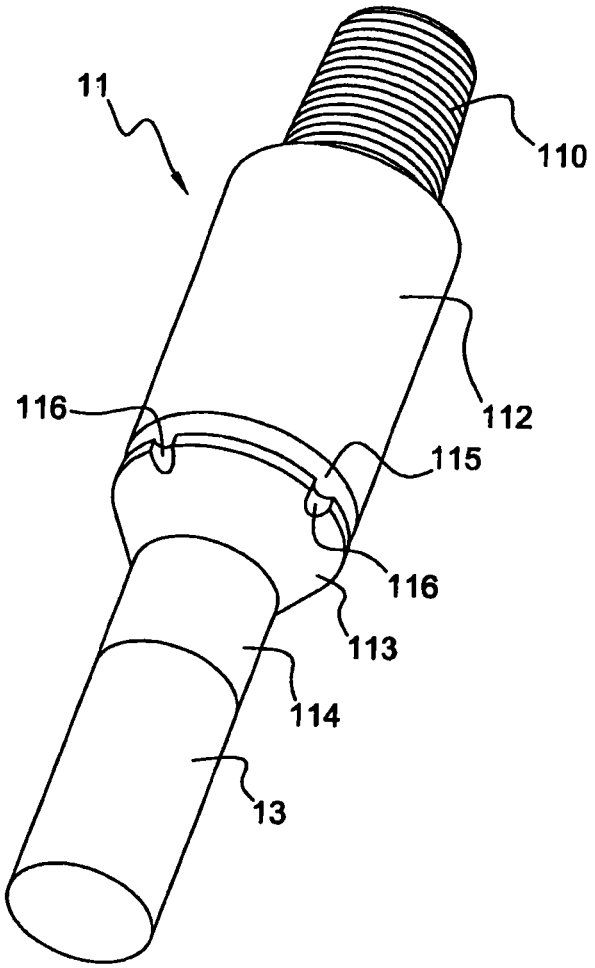

In the embodiment shown in FIG. 10, the shell (not shown in said figure) is not fixed by fixing the shell against the tapered portion of the tool joint, but by mounting the shell on the tool joint. In this case, the shell is constituted by two half-shells. The shell is secured in translation and rotation with respect to the tool joint by the fact that the internal circumferential surface of the shell and the external circumferential surface of the tool joint are complementary. The term "circumferential surface" means the surface which extends longitudinally over the whole contour of the tubular component. In contrast, the surfaces which extend radially at the free edges of the tubular component are not circumferential surfaces.

In this manner, the shell can be fitted onto the tool joint. Clearly, the two half-shells may be fixed together with screws. As an example as shown in FIG. 10, the third cylindrical portion 112 of the tool joint 11 comprises a circular groove 115 in which a complementary shape (not shown in FIG. 10) provided on the internal circumferential surface of the shell will be fitted. This arrangement can block translation along the axis 10 of the shell with respect to the tool joint. On the other hand, rotation is blocked by means of notches 116 provided on the third cylindrical portion 112 of the tool joint 11, said notches being able to accommodate complementary lugs provided on the internal circumferential surface of the shell.

In accordance with this embodiment detailed in FIG. 5, the shell 2 carries on its external circumferential surface, in succession, a first fluid activation zone 22, a first bearing zone 21, a second fluid activation zone 24, a second bearing zone 25 and a third fluid activation zone 23. This embodiment has the advantage of proposing a more complete solution to the problems of raising the debris, shocks and wear by friction against the well wall.

In order to facilitate the ascent of mud formed by the mixture of drilling fluid and debris, zones 22, 23 and 24 can be used to activate the flow of mud along the components, comprising grooves 220, 230, 240 formed on one portion of the external surface of the shells and extending in a helical manner about the axis 10 of the central tubular element.

In order to guide the mud along the component, the diameter of the shell increases in the upstream to downstream direction over the portion of the shell on which the first activation zone 22 is formed, this zone being the furthest upstream.

Similarly, the diameter of the shell decreases in the upstream to downstream direction over the portion of shell on which the third activation zone 23 is provided, this zone being the furthest downstream.

The fluid activation zones could be designed in accordance with the disclosures provided in French patent applications FR 2 789 438 and FR 2 835 014, herein incorporated by reference.

In order to reinforce the drilling components against shocks, the zones intended to bear on the wall of the well are completely or partially coated with materials with a high hardness.

In order to limit the friction between the shell and the well wall, the surface of the shell on which the first and second bearing zones 21, 25 are formed is convex.

In order to resist friction between the shell and the well wall, the first and second bearing zones 21, 25 have a diameter which is greater than the maximum diameter of the tubular element 13 and a hardness which is greater than the hardness of the tubular element 13.

The bearing zones could be designed in accordance with the disclosures provided in French application FR 2 851 608, hereby incorporated by reference.

Another concave intermediate activation zone 24 is provided between the two bearing zones 21, 25 in order to guide the mud along the component.

The activation zones and the bearing zones are connected together in a tangential manner.

The arrangement of the various functional zones may be selected in accordance with the disclosure in French application FR 2 927 937, hereby incorporated by reference.

For a drill stem such as that shown in FIG. 2, it is advantageous to provide all of the components located in the horizontal zone C close to the drill bit with shells comprising bearing zones. It is here where friction is high.

In contrast, in zones A and B, as surface 6 is approached, the spacing between the components provided with shells depends on the inclination of the well and the drilling parameters. Further, priority will have to be given to the fluid activation zones in order to contribute to lifting the mud to the surface.

Preferably, the shell is fixed on the tool joint carrying a male threaded zone. During assembly at the well, the drilling components arrive vertically in batches of n components which have already been assembled; currently, n=3. The end of the batch ready to be made up into the drill string advancing into the well generally carries a male threading, while the other end has a female threading. For this reason, it is easy to precede the operation for making up the batch onto the drill pipe string by an operation for mounting a shell or a set of shells. Further, the other end of the batch, in general carrying a female threading, is used for manipulation using elevators. In this case, the drill pipe string comprises components provided with shells with a periodicity equal to n, for example three. It is also possible to envisage having a different periodicity, such as 1.

The invention is not limited to the provision of fluid activation zones or bearing zones. The shell, and also the set of shells fixed on the tool joint, may be intended to house electronic components, for example intended for the measurement, processing and/or transmission of signals involved in the drilling operations.

The invention claimed is:

1. A rotary drill stem component for exploration of a hydrocarbon well with drilling mud in movement around the component from a bottom of the well towards a surface, the component comprising:

a central tubular element having an axis of revolution and extended on either side respectively by a first and a second tool joint each respectively and successively comprising a first cylindrical portion connected to the tubular element, a second tapered portion, a third cylindrical portion with a radius which is greater than that of the tubular element, and a threaded end which can connect the component to another component, the component comprising a shell with one or more functional zones, wherein the shell is mounted on one of the tool joints in a cohesive and removable manner, wherein the shell is screwed against the tapered second portion of one of the tool joints using screws accommodated in housings formed in the shell and in the tapered portion and coaxial therewith, and wherein the shell is fixed against the second tapered portion of one of the tool joints using at least one pin passing through the shell, the pin being fixed at one of its ends in a recess formed in the tool joint and by a nut screwed onto the other end of the pin.

2. A rotary drill stem component according to claim 1, wherein the shell comprises two half-shells and an internal circumferential surface of the shell and an external circumferential surface of the third cylindrical portion of one of the tool joints are complementary such that the shell can be fitted onto the third cylindrical portion.

3. A rotary drill stem component according to claim 1, wherein the component comprises a first and a second shell, one of two end faces of the first shell being capable of being fitted into one of two end faces of the second shell, such that the shells are secured together by a bayonet type fitting.

4. A rotary drill stem component according to claim 1, wherein the functional zones consist of a first fluid activation zone downstream of which a first bearing zone is provided, downstream of which a second fluid activation zone is provided, downstream of which a second bearing zone is provided, and downstream of which a third fluid activation zone is provided, terms upstream and downstream being defined with respect to direction of movement of mud along the component.

5. A rotary drill stem component according to claim 4, wherein the activation zones comprise a plurality of grooves hollowed into the surface of the shell and extending in a helical manner about the axis of the central tubular component.

6. A rotary drill stem component according to claim 5, wherein the surfaces on which respectively the first activation zone and the third activation zone are provided is inclined in the upstream to downstream direction such that it draws respectively further away from/nearer to the axis of the central tubular element, to guide mud along the component.

7. A rotary drill stem component according to claim 5, wherein the surface on which the second activation zone is provided is concave to guide mud along the component.

8. A rotary drill stem component according to claim 5, wherein the surface on which the first and second bearing zones are provided is convex to limit friction between the shell and the wall of the well.

9. A rotary drill stem component according to claim 5, wherein the activation zones and the bearing zones are connected together in a tangential manner.

10. A rotary drill stem component according to claim 1, wherein the shell is mounted in a cohesive and removable manner on a tool joint including a threaded male end.

11. A rotary drill stem component according to the claim 1, wherein the shell comprises two half-shells, securing at least in translation the shell to the tool joint securing being made by mating an outer circumferential surface of the tubular element and an inner circumferential surface of the shell.

12. A rotary drill stem component according to claim 11, wherein the circumferential surfaces comprise complementarily pins and hollows securing the shell to a drill stem component at least in translation.

13. A string of components of a rotary drill stem, wherein a component in accordance with claim 1 is involved in constitution of a drill pipe string with a periodicity equal to three.

* * * * *